US008215833B2

(12) United States Patent
Kouda et al.

(10) Patent No.: US 8,215,833 B2
(45) Date of Patent: Jul. 10, 2012

(54) DIAGNOSTIC APPARATUS FOR VEHICLE COOLING SYSTEM

(75) Inventors: Akinori Kouda, Kariya (JP); Naoki Kokubo, Nukata-gun (JP)

(73) Assignee: Denso Corporation, Kariya (JP)

( * ) Notice: Subject to any disclaimer, the term of this patent is extended or adjusted under 35 U.S.C. 154(b) by 330 days.

(21) Appl. No.: 12/559,935

(22) Filed: Sep. 15, 2009

(65) Prior Publication Data

US 2010/0067560 A1 Mar. 18, 2010

(30) Foreign Application Priority Data

Sep. 16, 2008 (JP) ..... 2008-235894

(51) Int. Cl.
*G01K 15/00* (2006.01)
*G01K 13/00* (2006.01)
*G01K 7/00* (2006.01)

(52) U.S. Cl. ..... 374/145; 374/1; 374/166; 374/112

(58) Field of Classification Search ..... 374/145, 374/1, 166, 112
See application file for complete search history.

(56) References Cited

U.S. PATENT DOCUMENTS 5,526,871 A * 6/1996 Musser et al. ..... 165/11.1
6,695,473 B2 2/2004 Unger et al.
2007/0033998 A1 * 2/2007 Wakahara et al. ..... 73/118.1

* cited by examiner

*Primary Examiner* — Lisa Caputo
*Assistant Examiner* — Mirellys Jagan
(74) *Attorney, Agent, or Firm* — Nixon & Vanderhye P.C.

(57) ABSTRACT

When the driving wind and the cooling wind are generated, based on the phenomenon in which the temperature difference is generated between the front surface and the rear surface of the radiator (14), the temperature difference between the detection value of the rear temperature sensor (22) and the detection value of the front temperature sensor (21) is compared with the abnormality determination value so that it is determined whether the front temperature sensor (21) and the rear temperature sensor (22) are properly fixed on the radiator (14), whereby it is determined whether the abnormality (unauthorized alteration) exists. By setting the abnormality determination value according to the ambient temperature and the vehicle speed, corresponding to a variation in temperature difference between the front surface and the rear surface of the radiator (14), the abnormality determination value is varied to be set at a proper value.

4 Claims, 6 Drawing Sheets

DIAGNOSTIC APPARATUS FOR VEHICLE COOLING SYSTEM

CROSS-REFERENCE TO RELATED APPLICATION

This application is based on Japanese Patent Application No. 2008-235894 filed on Sep. 16, 2008, the disclosure of which is incorporated herein by reference.

FIELD OF THE INVENTION

The present invention relates to a diagnostic apparatus for a vehicle cooling system which mounts a radiator provided with a function of purifying ambient air.

BACKGROUND OF THE INVENTION

In a cooling system of an internal combustion engine, there is a radiator supporting a catalyst. The catalyst purifies harmful matter such as ozone in atmosphere. In specific countries and regions, a vehicle mounting a radiator provided with an ambient air purifying function is given a favorable treatment in which an exhaust gas regulation is relaxed.

However, the radiator having the ambient air purifying function is more expensive than a general radiator. Thus, when the radiator having the ambient air purifying function is broken, there is a possibility to conduct an unauthorized alteration in which the radiator having the ambient air purifying function is changed into a cheap radiator having no ambient air purifying function. If such an unauthorized alteration of the radiator is conducted, it is necessary to detect the unauthorized alteration early and notify the driver by a warning lamp.

U.S. Pat. No. 6,695,473B2 shows that a temperature sensor is fixed at a vicinity of a coolant inlet of the radiator having the ambient air purifying function by a non-removable means. The temperature sensor cannot be removed unless the temperature sensor is broken. In this system, it is monitored whether a detection value of the temperature sensor indicates a similar behavior to a detection value of a coolant temperature sensor. By determining whether the temperature sensor is properly fixed on the radiator, it is determined whether the unauthorized alteration is conducted.

However, in a technology shown in U.S. Pat. No. 6,695,473B2, it may be happen that the temperature sensor fixed on the radiator having the ambient air purifying function is cut away and fixed on the coolant passage or a cylinder head. The detection value of the temperature sensor is made up to show a similar behavior of the coolant temperature sensor, and the radiator is changed into cheap radiator. When such an unauthorized alteration is conducted, since the detection value of the temperature sensor indicates a similar behavior of the detection value of the coolant temperature sensor, an unauthorized alteration can not be detected.

Furthermore, in U.S. Pat. No. 6,695,473B2, when a temperature sensor is fixed on the normal radiator, it is necessary to fix the temperature sensor at a vicinity of a coolant inlet in such a manner that a detection value of the temperature sensor indicates a similar behavior of the detection value of the coolant temperature sensor. Thus, a fixing position of the temperature sensor is limited to a narrow area at a vicinity of the coolant inlet, and it may be difficult to fix the temperature sensor smoothly.

SUMMARY OF THE INVENTION

The present invention is made in view of the above matters, and it is an object of the present invention to provide a diagnostic apparatus for a vehicle cooling system, which can surely detect an unauthorized alteration of a radiator and does not limit a fixing position of a temperature sensor to a narrow area.

According to the present invention, a diagnostic apparatus is for a vehicle cooling system which mounts a radiator provided with a function of purifying ambient air. The diagnostic apparatus includes a front temperature sensor fixed on a front surface of the radiator to detect a temperature of the front surface, and a rear temperature sensor fixed on a rear surface of the radiator to detect a temperature of the rear surface. The diagnostic apparatus further includes an abnormal diagnosis means which performs an abnormal diagnosis of the radiator based on a relationship between a detection value of the front temperature sensor and a detection value of the rear temperature sensor.

Generally, driving wind of a vehicle and cooling wind by the cooling fan 20 flow through the radiator from a front surface to a rear surface. When the driving wind and the cooling wind are generated, heat radiation amount at the front surface is greater than that at the rear surface. Temperature difference is generated between the front surface and the rear surface. The temperature of the front surface is lower than that of the rear surface. Based on such a temperature characteristic of the radiator, it is monitored whether a relationship between the detection value of the front temperature sensor and the detection value of the rear temperature sensor is maintained proper, whereby it is determined whether the front temperature sensor and the rear temperature sensor are properly fixed on the radiator and whether an abnormality (an unauthorized alteration) of the radiator exists.

If the front temperature sensor and the rear temperature sensor, which are fixed on the authorized radiator, are cut away with the sensor fixing portion and are fixed on the other portion, it is very difficult to maintain the proper relationship between the detection value of the front temperature sensor and the detection value of the rear temperature sensor. Thus, by monitoring the relationship between the detected value of the front sensor and the detected value of the rear sensor, the abnormality (unauthorized alteration) of the radiator can be certainly detected. Furthermore, only because the front temperature sensor and the rear temperature sensor are fixed on the authorized radiator in such a manner as to detect front temperature and rear temperature, the fixing positions of the temperature sensors are not limited to the narrow area of the radiator. Thus, it is easy to mount the radiator on the vehicle.

As a specific diagnosis method, it is determined that an abnormal of the radiator exists when a difference between the detection value of the rear temperature sensor and the detection value of the front temperature sensor is less than or equal to an abnormality determination value while a vehicle is running. While the vehicle is running, the driving wind flows through the radiator from the front surface to the rear surface and the temperature of the front surface is lower than that of the rear surface. Thus, when the front temperature sensor and the rear temperature sensor are properly fixed on the radiator, a difference between a detection value of the rear temperature sensor and a detection value of the front temperature sensor should be large. Thus, when the difference between the detection value of the rear temperature sensor and the detection value of the front temperature sensor is less than or equal to an abnormality determination value, it is determined that the front temperature sensor and the rear temperature sensor are not properly fixed on the radiator and it is determined that an abnormality (unauthorized alteration) of the radiator exists.

While a vehicle is running, a driving wind amount is varied in accordance with the vehicle speed, the radiation amount of the radiator is varied, and the temperature difference between the front surface and the rear surface of the radiator is also varied. The abnormality determination value may be varied in accordance with the vehicle speed or information relating thereto. Thereby, the abnormality determination value is varied corresponding to a variation in the temperature difference due to the vehicle speed. Finally, the abnormality determination value is set to an appropriate value in accordance with the temperature difference between the front surface and the rear surface of the radiator.

Further, while a vehicle stops and a cooling fan of a radiator is operated, when the temperature difference between the front surface and the rear surface of the radiator is less than or equal to an abnormality determination value, it may be determined that an abnormality of the radiator exists. While the cooling fan is operated even if the vehicle is stopped, the cooling wind flows through the radiator from the front surface to the rear surface and the coolant temperature at the front surface is lower than the coolant temperature at the rear surface. Thus, when the front temperature sensor and the rear temperature sensor are properly fixed on the radiator, a difference between a detection value of the rear temperature sensor and a detection value of the front temperature sensor should be large. Thus, while the vehicle stops and the cooling fan is operated, when the difference between a detection value of the rear temperature sensor and a detection value of the front temperature sensor is less than or equal to the abnormality determination value, it can be determined that the front temperature sensor and the rear temperature sensor are not properly fixed on the radiator, and it can be determined that an abnormality (unauthorized alteration) of the radiator exists.

Even if a driving wind and cooling wind are constant, a radiation amount of the radiator is varied according to ambient temperature and the temperature difference between the front surface and the rear surface is varied. The abnormality determination value may be varied in accordance with ambient temperature or information relating thereto. Thereby, the abnormality determination value is varied corresponding to a variation in the temperature difference due to the ambient temperature. Finally, the abnormality determination value is set to an appropriate value in accordance with the temperature difference between the front surface and the rear surface of the radiator.

Besides, when a coolant does not circulate through a radiator and/or a coolant temperature is less than or equal to a specified value, an abnormal diagnosis may be prohibited. When the coolant does not circulate through the radiator and/or the coolant temperature is less that or equal to the specified value, the radiator hardly radiate heat and the temperature difference between the front surface and the rear surface of the radiator is scarcely generated. Thus, it is hard to determine whether an abnormality of the radiator exists based on the relationship between the detection value of the front temperature sensor and the detection value of the rear temperature sensor. The abnormal diagnosis of the radiator is prohibited, so that a deterioration in the diagnosis accuracy is prevented.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Figure 1:
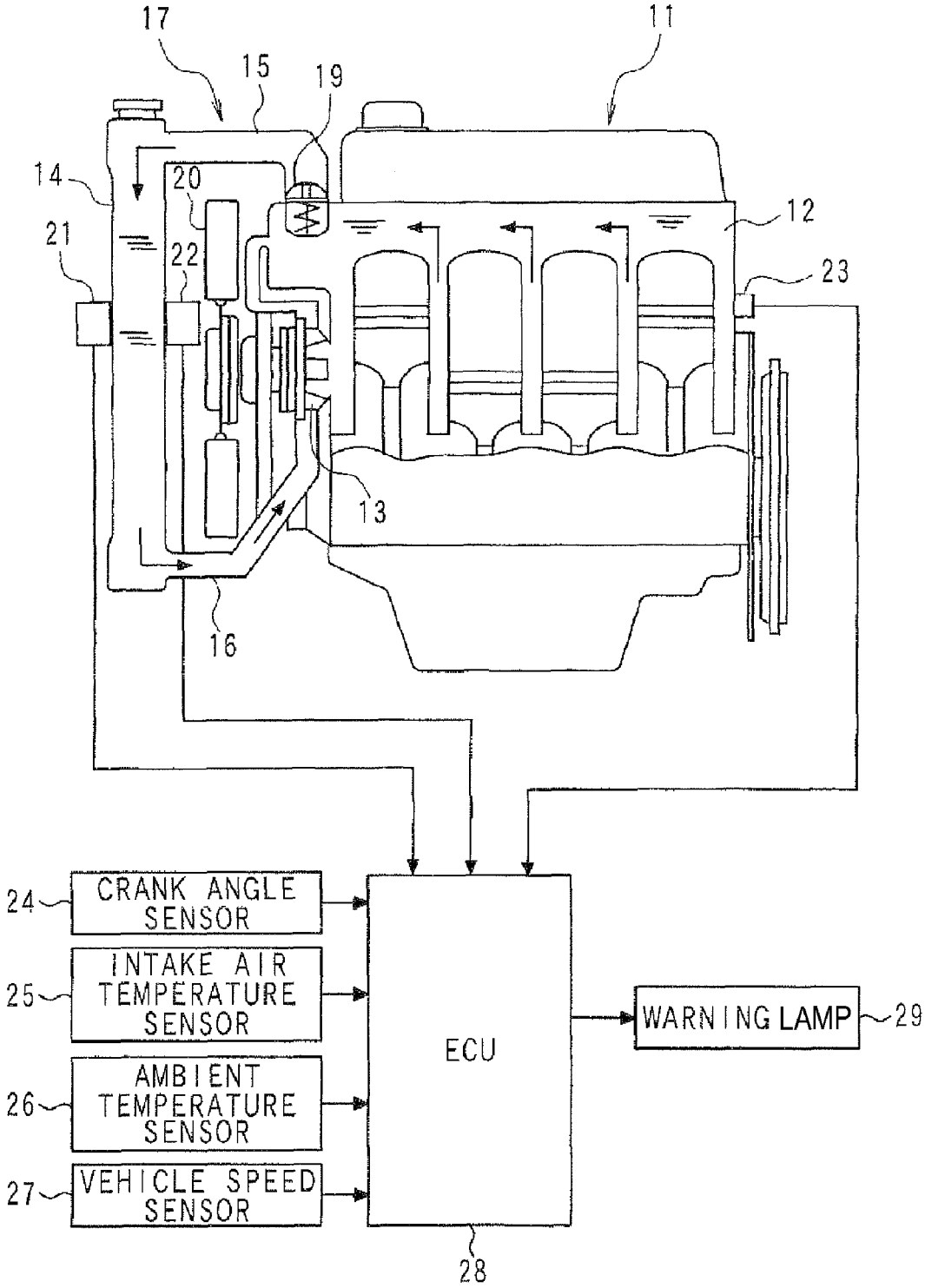
FIG. 1 is a schematic view of an engine cooling system according to an embodiment of the present invention.
Figure 2:
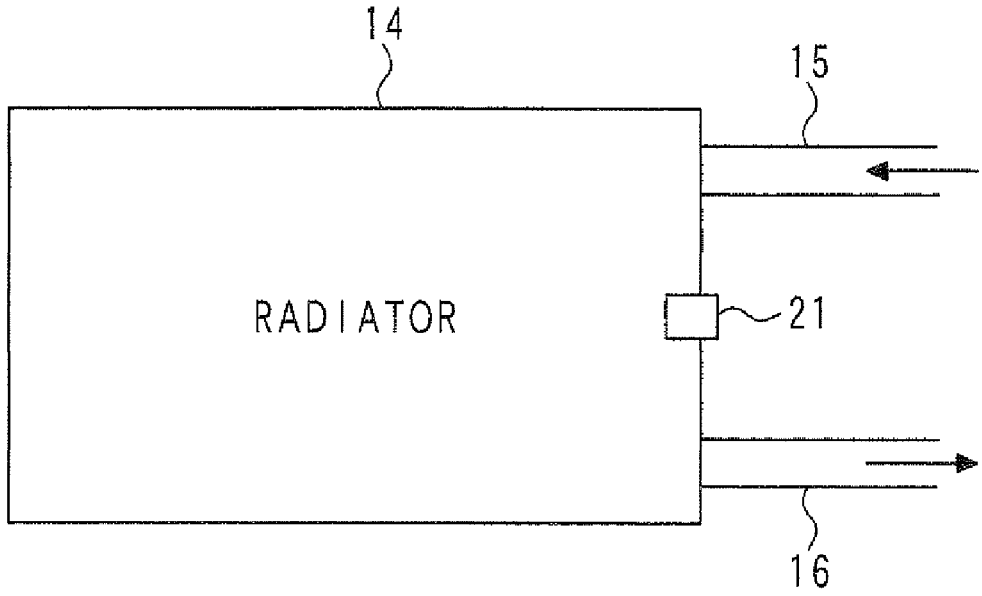
FIG. 2 is a front view of a radiator.
Figure 3:
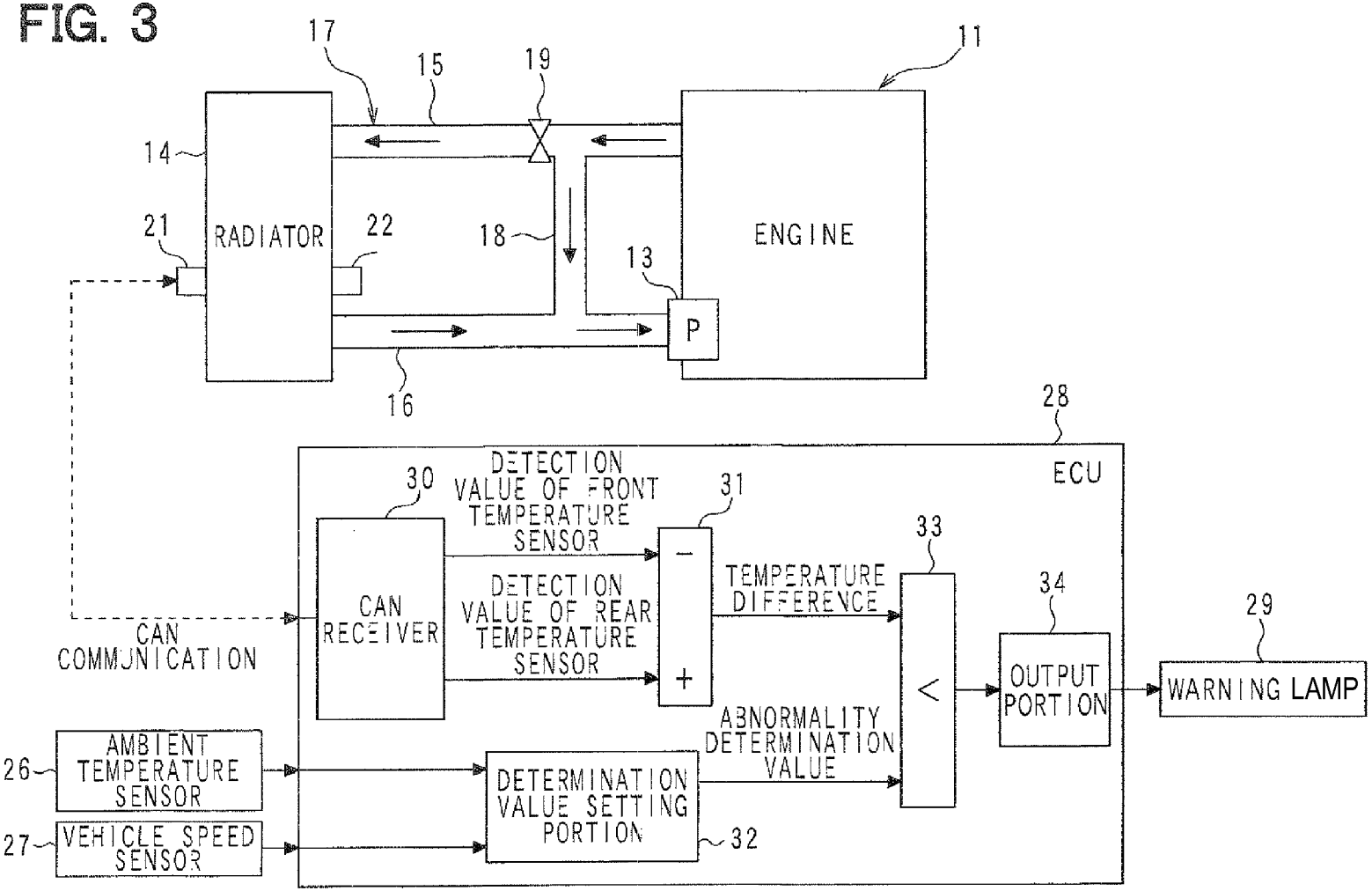
FIG. 3 is a block diagram schematically showing an abnormal diagnosis function of an ECU.

An embodiment of the present invention will be described hereinafter. Referring to FIGS. 1 to 3, an engine cooling system is explained. As shown in FIGS. 1 and 3, a water pump 13 is provided at an inlet of a coolant passage 12 (water jacket) of an internal combustion engine 11. This water pump 13 is a mechanical pump driven by the engine 11 or an electric pump driven by a motor.

An outlet of the coolant passage 12 is connected to an inlet of a radiator 14 through a first coolant circulation pipe 15. An outlet of the radiator 14 is connected to an inlet of the water pump 13 through a second coolant circulation pipe 16. Thereby, a coolant circulation circuit 17 is configured, in which the coolant flows through the coolant passage 12, the first coolant circulation pipe 15, the radiator 14, the second coolant circulation pipe 16, the water pump 13, and the coolant passage 12 in this series.

As shown in FIG. 3, the coolant circulation circuit 17 is provided with a bypass passage 18 in parallel with the radiator. Each of both ends of the bypass passage 18 is connected to the first and the coolant circulation pipe 15, 16. A thermostat valve 19 is provided at a connecting portion of the first coolant circulation pipe 15 and the bypass passage 18. When the coolant temperature is lower than a specified temperature, the thermostat valve 19 is closed so that the coolant from the engine 11 circulates in the bypass passage 18. A cooling fan 20 generating a cooling air is arranged at a vicinity of the radiator 14. This cooling fan 20 is a mechanical fan driven by the engine 11 or an electric fan driven by a motor.

A core portion of the radiator 14 is coated with a catalytic material which purifies harmful matters, such as ozone in atmosphere. A front temperature sensor 21 is provided on a front surface of the radiator 14 to detect front temperature of the radiator 14. A rear temperature sensor 22 is provided on a rear surface of the radiator 14 to detect rear temperature of the radiator 14. These temperature sensors 21, 22 are fixed on the radiator 14 in such a manner as to sandwich the radiator 14 by a non-removable means (not shown). That is, the temperature sensors 21, 22 can not be removed unless the temperature sensors 21, 22 are broken. In the present embodiment, these temperature sensors are provided between a coolant inlet of the radiator 14 (connecting portion of the first coolant circulation pipe 15) and a coolant outlet of the radiator 14 (connecting portion of the second coolant circulation pipe 16).

As shown in FIG. 1, a coolant temperature sensor 23 detecting a coolant temperature and a crank angle sensor 24 are installed on a cylinder block of the engine 11. The crank angle sensor 24 outputs crank angle pulses when a crank shaft rotates a predetermined angle. Based on these crank angle pulses of the crank angle sensor 24, a crank angle and an engine speed are detected. An intake air temperature sensor 25 detects intake air temperature, an ambient temperature sensor 26 detects ambient temperature, and a vehicle speed sensor 27 detects vehicle speed.

The outputs from the above sensors are inputted into an electronic control unit 28, which is referred to an ECU hereinafter. The ECU 28 includes a microcomputer which executes an engine control program stored in a Read Only Memory (ROM) to control a fuel injection quantity of a fuel injector (not shown) and an ignition timing of a spark plug (not shown) according to an engine running condition.

As shown in FIG. 3, the ECU 28 receives ID information through a CAN receiver 30. The ID information is transmitted from the front temperature sensor 21 and the rear temperature sensor 22 by CAN (Controller Area Network) communication. The ECU 28 verifies the ID information from the sensors 21, 22, and determines whether proper temperature sensors 21, 22 are connected to each other.

Figure 4:
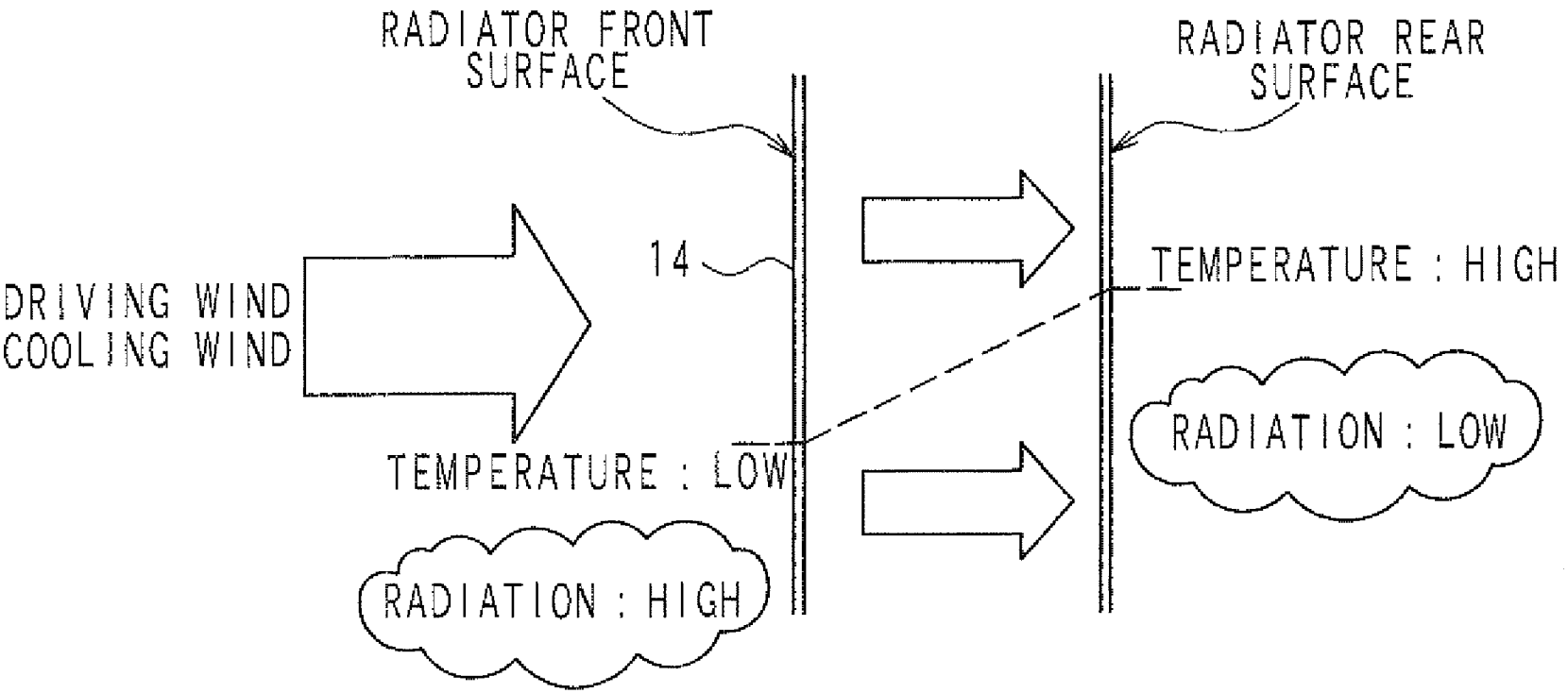
FIG. 4 is a chart for explaining a relationship between a front temperature and a rear temperature of a radiator.
Figure 5:
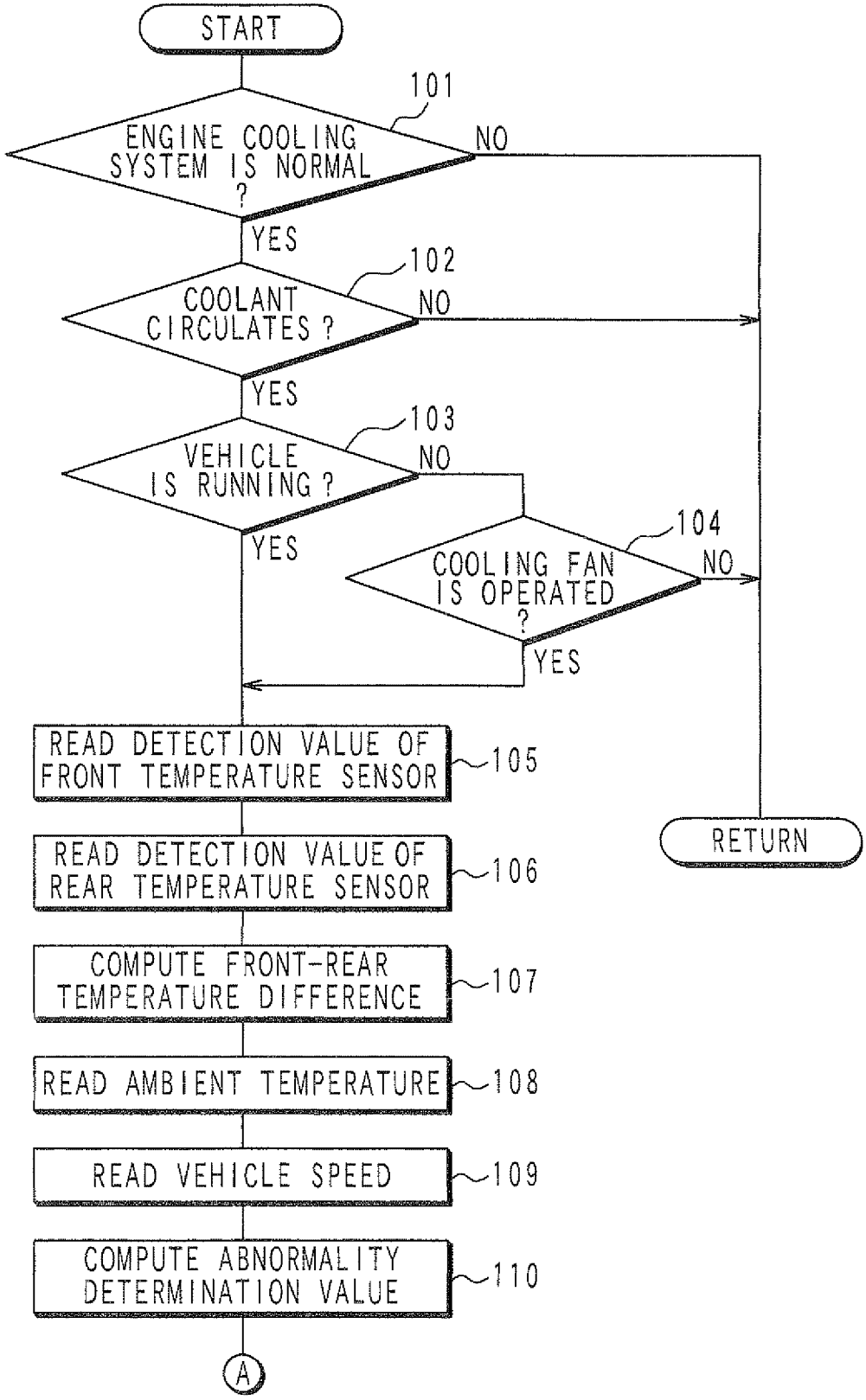
FIGS. 5 and 6 are flowcharts showing a processing of an abnormal diagnosis routine.
Figure 6:
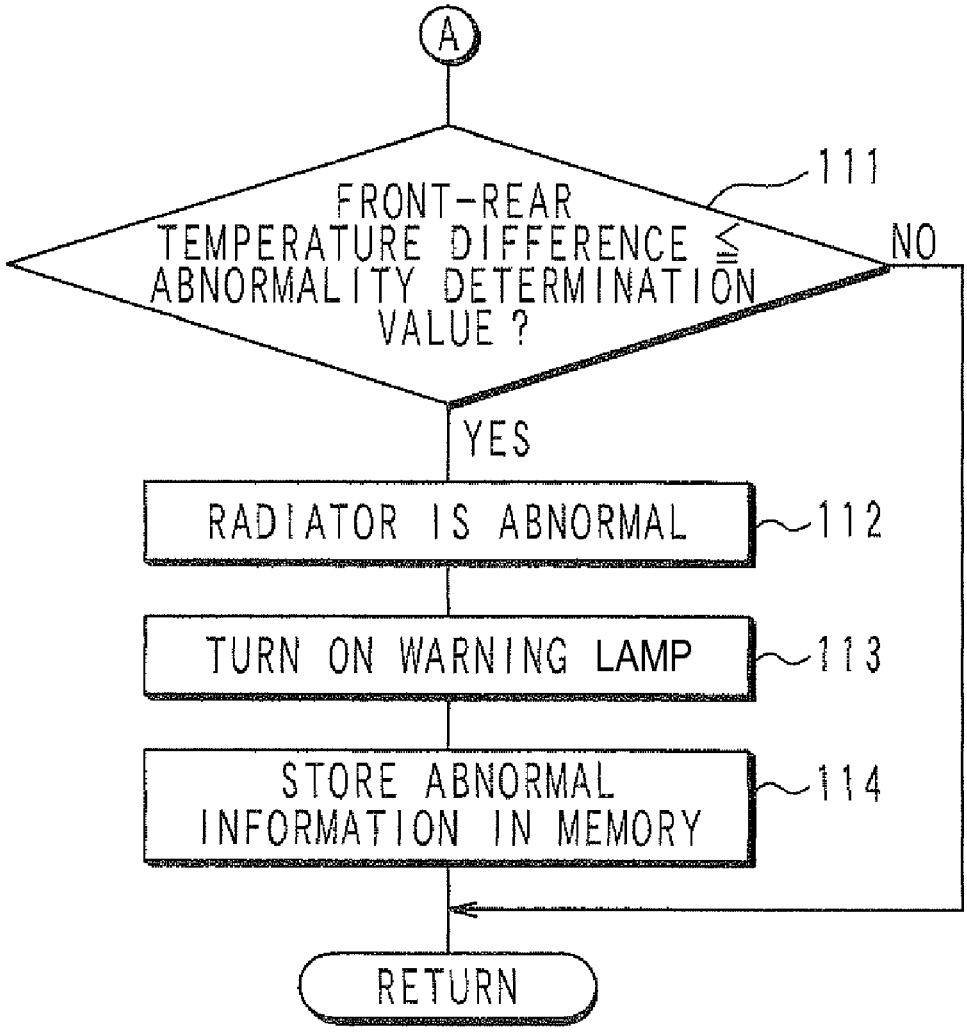

Furthermore, the ECU 28 executes an abnormal diagnosis routine shown in FIGS. 5 and 6 to perform an abnormal diagnosis of the radiator 14. As shown in FIG. 4, generally, driving wind of a vehicle and cooling wind by the cooling fan 20 flow through the radiator from a front surface to a rear surface. When the driving wind and the cooling wind are generated, heat radiation amount at the front surface is greater than that at the rear surface. Temperature difference is generated between the front surface and the rear surface. The temperature of the front surface is lower than that of the rear surface. Based on such a temperature characteristic of the radiator 14, it is monitored whether a relationship between the detection value of the front temperature sensor 21 and the detection value of the rear temperature sensor 22 is maintained proper, whereby it is determined whether the front temperature sensor 21 and the rear temperature sensor 22 are properly fixed on the radiator and whether an abnormality (an unauthorized alteration) exists.

While the vehicle is running, the driving wind flows through the radiator 14 from the front surface to the rear surface and the coolant temperature at the front surface is lower than the coolant temperature at the rear surface. Thus, when the front temperature sensor 21 and the rear temperature sensor 22 are properly fixed on the radiator 14, a difference between a detection value of the rear temperature sensor 22 and a detection value of the front temperature sensor 21 should be large.

While the cooling fan 20 is operated even if the vehicle is stopped, the cooling wind flows through the radiator 14 from the front surface to the rear surface and the coolant temperature at the front surface is lower than the coolant temperature at the rear surface. Thus, when the front temperature sensor 21 and the rear temperature sensor 22 are properly fixed on the radiator 14, a difference between a detection value of the rear temperature sensor 22 and a detection value of the front temperature sensor 21 should be large.

According to the present embodiment, when the vehicle is running and when the vehicle is stopped and the cooling fan 20 is operated, the temperature difference between the detection value of the rear temperature sensor 22 and the front temperature sensor 21 is compared with a specified abnormality determination value and it is determined whether the front temperature sensor 21 and the rear temperature sensor 22 are properly fixed on the radiator 14, so that it is determined whether the abnormality (unauthorized alteration) of the radiator 14 exists.

Specifically, as shown in FIG. 3, a temperature difference computing portion 31 obtains a front-rear temperature difference by computing the difference between the detection value of the rear temperature sensor 22 and the detection value of the front temperature sensor 21.

Front-rear temperature difference=Detection value of rear temperature sensor 22−Detection value of front temperature sensor 21

A determination value setting portion 32 computes an abnormality determination value based on an ambient temperature detected by an ambient temperature sensor 26 and a vehicle speed detected by a vehicle speed sensor 27 by use of maps or formulas. When the driving wind amount varies according to the vehicle speed and a radiation amount of the radiator 14 varies, the temperature difference between the front surface and the rear surface of the radiator 14 varies. Furthermore, when the radiation amount of the radiator 14 varies due to the ambient temperature, the temperature difference between the front surface and the rear surface of the radiator 14 varies. Therefore, by setting the abnormality determination value according to the ambient temperature and the vehicle speed, corresponding to a variation in temperature difference between the front surface and the rear surface of the radiator 14, the abnormality determination value is varied to be set at a proper value in accordance with the temperature difference between the front surface and the rear surface of the radiator 14.

Then, an abnormality determination portion 33 compares the front-rear temperature difference (a difference between the detection value of the rear temperature sensor 22 and the detection value of the front temperature sensor 21) with the abnormality determination value. As a result, when the front-rear temperature difference is less than the abnormality determination value, it is determined that the front temperature sensor 21 and the rear temperature sensor 22 are not properly fixed on the radiator 14 due to the unauthorized alteration. A warning signal output portion outputs a warning signal to turn on a warning lamp 29 provided on an instrument panel, so that the driver is notified of the abnormality of the radiator 14.

The abnormality diagnosis of the radiator 14 is executed by the ECU 28 according to an abnormality diagnosis routine shown in FIGS. 5 and 6. The process of this routine will be described hereinafter. The abnormality diagnosis routine shown in FIGS. 5 and 6 is executed at a specified time interval while the ECU 28 is energized. This routine functions as an abnormality diagnosis means. In step 101, it is determined whether each part configuring the engine cooling system, such as the front temperature sensor 21, the rear temperature sensor 22, the water pump 13, the thermostat valve 19, and the cooling fan 20 operates normally based on a diagnosis result of a self-diagnosis function. If no abnormality is detected, the routine ends without performing succeeding steps.

When it is confirmed that each part operates normally, the procedure proceeds to step 102 in which it is determined whether the thermostat valve 19 is opened to circulate the coolant from the engine 11 to the radiator 14 based on whether the engine coolant temperature is greater than a specified temperature.

When it is determined that the thermostat valve 19 is closed so that the engine coolant does not circulated in the radiator 14, the radiator 14 hardly radiate the heat and the temperature difference is scarcely generated between the front surface and the rear surface of the radiator 14. Thus, it is hard to correctly determine whether abnormality of the radiator 14 exists based on a relationship between the detection value of the front temperature sensor 21 and the detection value of the rear temperature sensor 22. The routine ends without performing the succeeding steps and the abnormality diagnosis of the radiator 14 is prohibited. This function corresponds to an abnormality diagnosis prohibiting means.

When it is determined that the thermostat valve 19 is opened to circulate the coolant from the engine 11 to the radiator 14, the procedure proceeds to step 103. In step 103, it is determined whether the vehicle is running. When the answer is No in step 103, the procedure proceeds to step 104 in which it is determined whether the cooling fan 20 is operated.

When the answer is Yes in step 103 or when the answer is Yes in step 104, the procedure proceeds to step 105 in which the detection value of the front temperature sensor 21 is read. Then, the procedure proceeds to step 106 in which the detection value of the rear temperature sensor 22 is read.

Then, the procedure proceeds to step 107 in which the front-rear temperature difference is obtained by computing the difference between the detection value of the rear temperature sensor 22 and the detection value of the front temperature sensor 21.

In step 108, the ambient temperature detected by the ambient temperature sensor 26 is read. In step 109, the vehicle speed detected by the vehicle speed sensor 27 is read. Then, the procedure proceeds to step 110 in which the abnormality determination value is computed according to the ambient temperature and the vehicle speed by use of maps or formulas. Thereby, the abnormality determination value is varied corresponding to a variation in the temperature difference due to the ambient temperature and vehicle speed. Finally, the abnormality determination value is set to an appropriate value in accordance with the temperature difference between the front surface and the rear surface of the radiator 14.

Then, the procedure proceeds to step 111 in FIG. 6 in which the front-rear temperature difference is lower than or equal to the abnormality determination value. When the answer is Yes in step 111, it is determined that the front temperature sensor 21 and the rear temperature sensor 22 are not properly fixed on the radiator 14 due to the unauthorized alteration. The procedure proceeds to step 112 in which it is determined that an abnormality (unauthorized alteration) of the radiator 14 exists and an abnormal flag is turned On.

Then, the procedure proceeds to step 113 in which the warning lamp 29 provided on the instrument panel is turned On to notify the driver of the abnormality of the radiator 14. In step 114, abnormal information (abnormal codes) are stored in a nonvolatile memory such as a backup RAM (not shown) of the ECU 28 to end the routine.

When the answer is No in step 111, the front temperature sensor 21 and the rear temperature sensor 22 are properly fixed on the radiator 14 and it is determined that the abnormality (unauthorized alteration) does not exist to end the routine.

According to the present embodiment, when the driving wind and the cooling wind are generated, based on the phenomenon in which the temperature difference is generated between the front surface and the rear surface of the radiator 14, the temperature difference between the detection value of the rear temperature sensor 22 and the detection value of the front temperature sensor 21 is compared with the abnormality determination value so that it is determined whether the front temperature sensor 21 and the rear temperature sensor 22 are properly fixed on the radiator 14, whereby it is determined whether the abnormality (unauthorized alteration) exists.

If the front temperature sensor 21 and the rear temperature sensor 22, which are fixed on the authorized radiator 14, are cut away with the sensor fixing portion and are fixed on the other portion, it is very difficult to maintain the proper relationship between the detection value of the front temperature sensor 21 and the detection value of the rear temperature sensor 22. Thus, by comparing the temperature difference with the abnormality determination value, the abnormality (unauthorized alteration) of the radiator 14 can be certainly detected. Furthermore, only because the front temperature sensor 21 and the rear temperature sensor 22 are fixed on the authorized radiator 14 in such a manner as to detect front temperature and rear temperature, the fixing positions of the temperature sensors 21, 22 are not limited to the narrow area of the radiator 14. Thus, it is easy to mount the radiator on the vehicle.

In addition, according to the present embodiment, since the abnormality determination value is set in accordance with the ambient temperature and the vehicle speed, the abnormality determination value is varied corresponding to the variation in temperature difference between the front surface and the rear surface of the radiator 14, so that the abnormality determination value can be set to an appropriate value in accordance with the temperature difference between the front surface and the rear surface of the radiator 14.

According to the present embodiment, when the thermostat valve 19 is closed and the coolant does not circulate through the radiator 11, the radiator 14 hardly radiate heat and the temperature difference between the front surface and the rear surface of the radiator 14 is scarcely generated. Thus, it is hard to determine whether an abnormality of the radiator 14 exists based on the relationship between the detection value of the front temperature sensor 21 and the detection value of the rear temperature sensor 22. The abnormal diagnosis of the radiator 14 is prohibited, so that a deterioration in the diagnosis accuracy is prevented.

In the above embodiment, the temperature difference between the detection value of the rear temperature sensor 22 and the detection value of the front temperature sensor 21 is compared with the abnormality determination value. Alternatively, a temperature ratio between the detection value of the rear temperature sensor 22 and the detection value of the front temperature sensor 21 may be compared with the abnormality determination value to determine whether an abnormality (unauthorized alteration) of the radiator 14 exists.

In the above embodiment, the diagnosis of the radiator 14 is performed in a case that the vehicle is running and in a case that the cooling fan 20 is operated with the vehicle stopped. Alternatively, the diagnosis of the radiator 14 may be performed in only one of both cases.

In the above embodiment, the abnormality determination value is varied in accordance with the ambient temperature and the vehicle speed. In a system having no ambient temperature sensor, the abnormality determination value may be varied in accordance with information relating to the ambient temperature such as the intake air temperature detected by the intake air temperature sensor 25. Alternatively, the abnormality determination value may be varied in accordance with information relating to the vehicle speed such as engine speed and gear position.

In the above embodiment, when the thermostat valve 19 is closed and the coolant does not circulate through the radiator 14, the abnormal diagnosis of the radiator 14 is prohibited. Alternatively, when the coolant temperature is less than a specified value, the abnormal diagnosis of the radiator 14 may be prohibited irrespective of an opening/closing of the thermostat valve 19.

In the above embodiment, the present invention is applied to the system provided with the thermostat valve 19 in the coolant circulation circuit 17. The present invention can be applied to a system provided with an electromagnetic valve in stead of the thermostat valve 19.

The present invention should not be limited to the disclosed embodiment, but may be implemented in other ways without departing from the spirit of the invention. For example, the fixing position of the temperature sensors 21, 22 can be changed accordingly.

What is claimed is:

1. A diagnostic apparatus for a vehicle cooling system which mounts a radiator provided with a function of purifying an ambient air passing therethrough, comprising:

a front temperature sensor integrally fixed on a front surface of the radiator to detect a temperature of an air flowing into the front surface of the radiator;

a rear temperature sensor integrally fixed on a rear surface of the radiator to detect a temperature of an air flowing out from the rear surface of the radiator; and an abnormal diagnosis unit configured to perform an abnormal diagnosis of the radiator based on a relationship between a detection value of the front temperature sensor and a detection value of the rear temperature sensor, wherein when a difference between the detection value of the rear temperature sensor and the detection value of the front temperature sensor is less than or equal to an abnormality determination value, the abnormal diagnosis unit determines that the radiator is altered to an unauthorized radiator having no function of purifying ambient air.

2. A diagnostic apparatus according to claim 1, wherein the front temperature sensor and the rear temperature sensor can not be removed from the radiator unless the temperature sensors are broken.

3. A diagnostic apparatus according to claim 1, wherein the front temperature sensor and the rear temperature sensor are fixed on the radiator in such a manner as to sandwich the radiator.

4. A diagnostic apparatus according to claim 1, wherein a coolant inlet passage and a coolant outlet passage are connected to the radiator having the front temperature sensor fixed on the front surface of the radiator and having the rear temperature sensor fixed on a rear surface of the radiator.

* * * * *